US009739091B1

(12) United States Patent
Pucci

(10) Patent No.: US 9,739,091 B1
(45) Date of Patent: Aug. 22, 2017

(54) PAINTING TOOL HOLDER FOR ALL TYPES OF EXTENSION LADDERS

(71) Applicant: Ezra Cole Pucci, Sonoma, CA (US)

(72) Inventor: Ezra Cole Pucci, Sonoma, CA (US)

(73) Assignee: Ezra C. Pucci, Sonoma, CA (US)

( * ) Notice: Subject to any disclaimer, the term of this patent is extended or adjusted under 35 U.S.C. 154(b) by 0 days.

(21) Appl. No.: 15/135,538

(22) Filed: Apr. 21, 2016

(51) Int. Cl.

| | |
|---|---|
| ***A62C 13/76*** | (2006.01) |
| ***E06C 7/14*** | (2006.01) |
| ***B44D 3/12*** | (2006.01) |
| ***B44D 3/14*** | (2006.01) |

(52) U.S. Cl.
CPC ..... *E06C 7/14* (2013.01); *B44D 3/123* (2013.01); *B44D 3/14* (2013.01)

(58) Field of Classification Search
CPC E06C 7/143; E06C 7/14; B44D 3/123; B44D 3/14
See application file for complete search history.

(56) References Cited

U.S. PATENT DOCUMENTS

| | | | | |
|---|---|---|---|---|
| 5,960,905 | A * | 10/1999 | Gardner | E06C 7/143 182/129 |
| 2007/0221802 | A1* | 9/2007 | New | E06C 7/143 248/210 |
| 2011/0057079 | A1* | 3/2011 | Reusser | E06C 7/143 248/210 |

* cited by examiner

*Primary Examiner* — Amy Sterling

(57) ABSTRACT

The present invention is a paint tool holder that can be attached to any extension ladder with the main objective to hold a variety and multitude of tools, such as: (1) paint roller frames, (2) 1 to 5 gallon paint buckets, containers and pails; (3) paint spray guns; (4) tape masking machines; (6) caulking guns; (7) tape rolls and more. The paint tool holder includes a rod attached to the bucket holder and stabilizer to hold the bucket firm and steady so that a user is able to easily paint. The paint tool holder can be attached to either side of the extension ladder thus making it very comfortable to work for either a left or right-handed user.

8 Claims, 2 Drawing Sheets

PAINTING TOOL HOLDER FOR ALL TYPES OF EXTENSION LADDERS

BACKGROUND OF THE INVENTION

Ladders are customarily required for painting. A particular problem in painting from a ladder is the necessity of carrying the paint receptacle up and down the ladder. Furthermore, paint trays and other receptacles used for retaining the paint for roller-type painting are particularly difficult to place on the ladder without danger of tipping or spilling. Moreover, the roller-type trays have limited capacity for storing paint as well as for securing brushes or rollers against accidentally dropping from the ladder when not in use. Another problem that exists while working on a ladder is the inability to hold other tools.

There have been several solutions to these problems. One solution is to provide a shelf on a step ladder. Step ladders, however, cannot be used in many situations because their A-frame construction often requires more space than is available and they are useful only for relatively low heights. Another type of ladder which has a lack of solutions is the rung-type ladder. One solution for rung-type ladders has been to hang a pail can from the bale by a hook or wire that is suspended from a ladder rung. Unfortunately, this allows the paint can to sway easily in response to wind or even the slightest force of wiping the brush against the inside rim of the paint can so that excess paint can be removed. Moreover, the paint can hangs in the ladder rung or behind the ladder, making access to it awkward and dangerous.

In general, there are many kinds of equipment that can be used with an extension ladder to assist in painting, but they are not user friendly. Some of them are not compatible with left and right and hand users.

The most common tool for holding buckets while working and/or painting on the extension ladder is the "S" hook style device. Although this device can be attached to the handle of the containers and buckets, which holds the handle or pail up due to the weight of the material and the container, the major disadvantage in using this device is that it prevents the user from effectively removing the brush or roller from the container without the handle getting in the way. Moreover, this device does not provide a secure or stable unit to work from because the container is likely to sway back and forth during use and is attached over the ladder rung, which encroaches in the user's workspace.

There is a need for a painting tools holder that can be properly attached to the extension ladder and provide safety and efficiency during working. Specifically, there is a need for a device that can support and hold the paint cans and buckets of the user and also to hold the essential painting tools.

The present invention relates to a painting tools holder that can be used with any extension ladder and can hold a variety of tools.

BRIEF SUMMARY OF THE INVENTION

The present invention is a holder that can be attached to all kinds of extension ladders with the main objective to hold a variety and multitude of painters tools, such as: (1) paint roller frames, (2) 1 to 5 gallon paint buckets, containers and pails; (3) paint spray guns; (4) paint roller frames; (5) tape masking machines; (6) caulking guns; (7) tape rolls and more.

It is the objective of the invention to hold a wide variety of other tools and accessories for other purposes. The holder can be used by both left and right handed people.

It is also the objective of the invention to allow the user full access to the opening of containers so that the user can brush and roll to its full ability without the container swinging around the handle.

It is also the objective of the invention to the let the user freely use a paint roller frame, paint and paint grid inserted into the container or bucket without any interference from the handle/bail. It provides the ability to the user to paint from different heights or sections of the ladder and perform the same rolling ability and stability that can be achieved at the ground.

These and other features, objects and advantages of the present invention will be readily apparent to persons of ordinary skill in the art upon reading the entirety of this disclosure, which includes the accompanying drawings and claims.

REFERENCE NUMERALS USED IN THE DRAWINGS AND DESCRIPTION

Detailed Description of the Invention

In the present disclosure, numerous specific details are provided, such as examples of module, components, and methods, to provide a thorough understanding of embodiments of the invention. Persons of ordinary skill in the art will recognize, however, that the invention can be practiced without one or more of the specific details. In other instances, well-known details are not shown. This painting tool holder 101 will provide the user a much safer working environment and create better efficiencies. The user is also more productive while minimizing common dangers of multi-tasking while working on an extension ladder.

Figure 1:
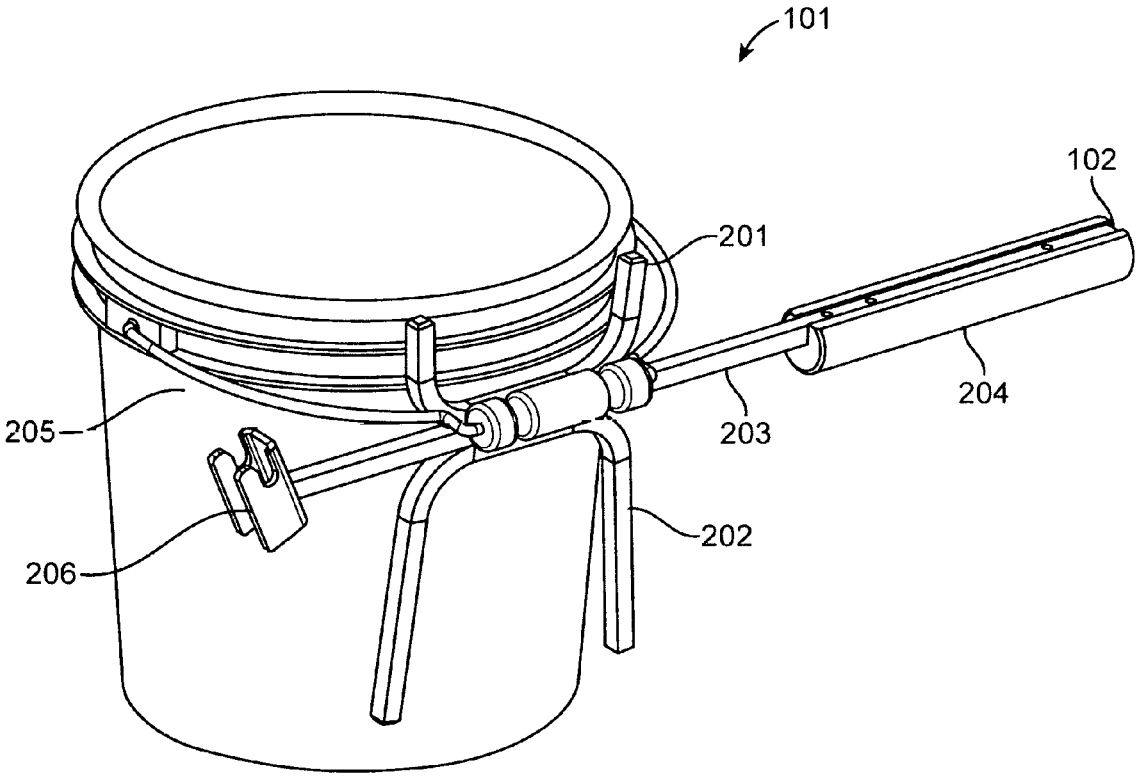
FIG. 1 is a perspective view of the painting tools holder.

FIG. 1 is the painting tool holder 101. The paint tool holder 101 has a rod 203. The rod 203 has a cover 204. The combination of the rod 203 with the cover 204 is the insertion end 102 which can be inserted into the ladder. The insertion end 102 can be any shape or size as long as it fits within a rung of the ladder. The painting tool holder 101 also has a (I.) stabilizer 202 and a (II.) bucket holder 201.

I. Stabilizer

The stabilizer 202 can be any shape or size as long as it prevents the movement of the bucket 205. The stabilizer 202 is attached to the rod 203 to support and stop the swinging of the bucket 205. To further elaborate, the stabilizer 202 prevents the bucket 205 from moving when it is windy or there is motion which moves the bucket 205.

II. Bucket Holder

The bucket holder 201 may be any shape or size as long as it holds the bucket 205. The bucket holder 201 can hold a bucket 205 ranging from 1 to 5 gallons. In FIG. 1, the bucket holder 201 which is U shaped can be attached by any means to a rod 203. In one embodiment, the means is welding. The bucket holder 201 can also be an upside down U shape and can also serve as a handle to carry the paint tool holder 101. The bucket holder 201 may also serve to hold any painter's tools and does not have to be used exclusively for a paint bucket.

Figure 2:
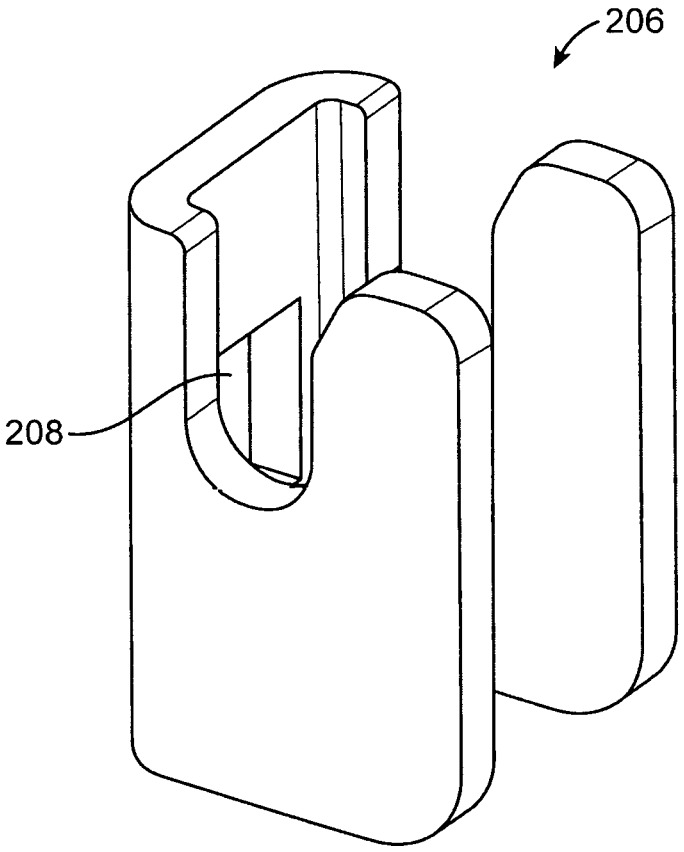
FIG. 2 is a perspective view of the paint roller frame holder.

The stabilizer 202 and the bucket holder 201 are connected to the rod 203. In one embodiment, the stabilizer 202, the bucket holder 201, and the rod 203 are one integrated unit. The cover 204 is attached to the rod 203 and may support and hold painting tools on any kind of extension ladder. The rod 203 is connected to a paint frame holder 206 by any means. The paint frame holder 206 helps the tool stay in place. The paint frame holder 206 can be any shape as long as it helps the tool stay in place and is connected to rod 203. In one embodiment, as shown in FIG. 2, the paint frame holder 206 is u-shaped. In the same embodiment, as shown in FIG. 2, the paint roller frame holder 206 has a paint frame holder opening 208. In this embodiment, the paint roller frame holder 206 is attached to the rod 203 through the paint frame holder opening 208 (shown in FIG. 2) at an angle. In one embodiment the angle is at least about 12 degrees. The paint roller frame holder 206 can be attached at any angle such that the tool placed inside the paint roller frame holder 206 is able to stay within the paint frame holder without falling out. The paint tool holder 101 can also be used to hold the spray guns while painting.

The cover 204 over the rod 203 provides a smooth friction free insertion of the insertion end 102 making it easy to insert the paint tool holder 102 into the extension ladder. The cover 204 can be made from plastic and can be attached to the rod 203 by any means such as screws. In one example, the screws can be attached to the rod 203.

The U shaped bucket holder 201 gives a user the freedom to use a paint roller frame, paint and paint grid inserted into the container, or bucket without any interference from the handle of the bucket. This feature of the invention gives the user the ability to paint from different heights or sections of the ladder and perform with the same rolling ability and stability as it can be painted on the ground.

The rod 203 is of proper size to easily handle attachment of painter's spray guns, caulking guns and masking machines. In one example, the rod 203 holds a painter's spray gun to provide ease of use while working.

The present invention is very useful for the painters while working on the extension ladders to hold the paint tools. This invention helps the painter to work easily and more comfortably on the extension ladders.

While the foregoing written description of the invention enables one of ordinary skill to make and use what is considered presently to be the best mode thereof, those of ordinary skill will understand and appreciate the existence of variations, combinations and equivalents of the specific embodiment, method, and examples herein. The invention should thereof not to be limited by the above embodiment, method, and examples, but by all embodiments and methods within the scope and spirit of the invention as claimed.

While specific embodiments of the present invention have been provided, it is to be understood that these embodiments are for illustration purposes and not limiting. Many additional embodiments will be apparent to persons of ordinary skill in the art reading this disclosure.

What claimed is:

1. A paint tool holder 101 comprising:

a.) a rod 203 with a first end 102 and a second end, wherein the first end 102 includes a cover 204 attached thereto to facilitate insertion of the first end 102 into a rung of an extension ladder, and wherein the second end is connected to a paint roller frame holder 206 through an opening 208 provided on the paint roller frame holder 206;

b.) a bucket holder 201 attached to the rod 203 to facilitate holding of a paint bucket 205, and one or more painter's tools, wherein the bucket holder 201 enables a user to access the paint bucket 205 using the one or more painter's tools without interference from a handle of the paint bucket 205; and c.) a stabilizer 202 attached to the rod 203 to provide necessary support to prevent movement of the paint bucket 205.

2. The paint tool holder 101 as recited in claim 1, wherein the paint roller frame holder 206 is attached to the rod 203 at an angle such as to retain the painter's tool kept inside the paint roller frame holder 206.

3. The paint tool holder 101 as recited in claim 1, wherein the paint roller frame holder 206 is U shaped.

4. The paint tool holder 101 as recited in claim 1, wherein the cover 204 attached to the first end 102 of the rod 203 is made of plastic.

5. The paint tool holder 101 as recited in claim 4, wherein the cover 204 is attached to the first end 102 of the rod 203 using screws.

6. The paint tool holder 101 as recited in claim 1, wherein the bucket holder 201 is U shaped.

7. The paint tool holder 101 as recited in claim 1, wherein the bucket holder 201 may be made upside down U shaped to serve as a handle enabling the user to carry the paint tool holder 101.

8. The paint tool holder 101 as recited in claim 1, wherein the cover 204 attached onto the first end 102 of the rod 203 using screw means.

* * * * *